US012054936B1

(12) United States Patent
Boss

(10) Patent No.: US 12,054,936 B1
(45) Date of Patent: Aug. 6, 2024

(54) BUILDING MANUFACTURING USING LAYERED MATERIALS

(71) Applicant: BMIC LLC, Dallas, TX (US)

(72) Inventor: Daniel E. Boss, Morristown, NJ (US)

(73) Assignee: BMIC LLC, Dallas, TX (US)

( * ) Notice: Subject to any disclaimer, the term of this patent is extended or adjusted under 35 U.S.C. 154(b) by 159 days.

(21) Appl. No.: 17/591,426

(22) Filed: Feb. 2, 2022

Related U.S. Application Data

(60) Provisional application No. 63/240,628, filed on Sep. 3, 2021, provisional application No. 63/144,700, filed on Feb. 2, 2021.

(51) Int. Cl.

| | |
|---|---|
| ***E04B 1/343*** | (2006.01) |
| ***E04B 1/38*** | (2006.01) |
| ***E04B 2/00*** | (2006.01) |
| ***E04C 2/284*** | (2006.01) |
| ***E04C 2/52*** | (2006.01) |
| *E04C 2/00* | (2006.01) |

(52) U.S. Cl.
CPC ..... *E04B 1/34321* (2013.01); *E04B 1/34384* (2013.01); *E04B 1/388* (2023.08); *E04C 2/284* (2013.01); *E04C 2/46* (2013.01); *E04C 2/526* (2013.01); *E04B 1/34317* (2023.08); *E04C 2002/004* (2013.01)

(58) Field of Classification Search
CPC ..... E04B 1/34317; E04B 1/34321; E04B 1/34384; E04B 1/388; E04C 2/284; E04C 2/46; E04C 2/526; E04C 2002/004
USPC ..... 52/157
See application file for complete search history.

(56) References Cited

U.S. PATENT DOCUMENTS

| | | | | |
|---|---|---|---|---|
| 9,249,663 | B2 * | 2/2016 | Ma | E21D 11/28 |
| 9,388,078 | B2 | 7/2016 | Rael | |
| 9,797,135 | B2 * | 10/2017 | Nguyen | E04C 2/06 |
| 10,430,757 | B2 * | 10/2019 | Conboy | G06K 19/0723 |
| 10,618,217 | B2 | 4/2020 | Boyd et al. | |

(Continued)

OTHER PUBLICATIONS

Pacewicz et al., "Charateristic of materials for the 3D printed building constructions by additive printing", MATEC Web of Conferences 222, 01013 (2018); ORSDCE 2018.

(Continued)

*Primary Examiner* — James J Buckle, Jr.
(74) *Attorney, Agent, or Firm* — GREENBERG TRAURIG, LLP

(57) ABSTRACT

A kit includes a plurality of wall members. In some embodiments, each of the plurality of wall members includes an exterior surface material. In some embodiments, the exterior surface material passes an accelerated weathering test simulating damage caused by outdoor weathering. In some embodiments, each of the plurality of wall members include an interior surface material. In some embodiments, the interior surface material passes an environmental quality test. In some embodiments, the exterior surface material is different than the interior surface material. In some embodiments, the kit includes a plurality of brackets. In some embodiments, the plurality of brackets is configured to join a first of the plurality of wall members and a second of the plurality of wall members. In some embodiments, each of the plurality of brackets includes the exterior surface material and the interior surface material. In some embodiments, the kit includes a door.

18 Claims, 16 Drawing Sheets

(56) References Cited

U.S. PATENT DOCUMENTS

| | | | | |
|---|---|---|---|---|
| 11,220,820 | B2 * | 1/2022 | Du | E04B 1/388 |
| 11,680,403 | B2 * | 6/2023 | Perez | E04C 2/523 52/302.3 |
| 2005/0223652 | A1 * | 10/2005 | Mower | E04B 1/34321 52/79.1 |
| 2005/0223655 | A1 * | 10/2005 | Mower | E04H 1/1205 52/79.5 |
| 2006/0277852 | A1 * | 12/2006 | Mower | E04H 1/1205 52/270 |
| 2007/0209295 | A1 * | 9/2007 | Mower | E04B 1/34321 52/79.1 |
| 2009/0300999 | A1 * | 12/2009 | Ferriere | E04G 21/147 52/79.9 |
| 2010/0281784 | A1 * | 11/2010 | Leo | E04B 5/48 52/633 |
| 2010/0325989 | A1 * | 12/2010 | Leahy | E04B 1/34321 52/270 |
| 2011/0203724 | A1 | 8/2011 | Stokes et al. | |
| 2014/0053481 | A1 * | 2/2014 | Leahy | E04B 1/34321 52/270 |
| 2017/0306610 | A1 * | 10/2017 | Leahy | E04B 1/74 |
| 2021/0040722 | A1 * | 2/2021 | Morrow | E04B 2/18 |
| 2021/0207375 | A1 * | 7/2021 | Leahy | E04C 2/46 |
| 2022/0090379 | A1 * | 3/2022 | Perez | E04C 2/36 |
| 2022/0259860 | A1 * | 8/2022 | Moller | E04H 1/125 |

OTHER PUBLICATIONS

Aries; "3D Printed Modular Housing? REALLY?!"; 2022 Aries Buildings Systems, LLC <<https://ariesbuildings.com/3d-modular-housing/>> retrieved Feb. 2, 2022.

Blokable, Blokable Building System; 2021 Blokable Inc. <<https://blokable.com/bbs/>> retrieved Feb. 2, 2022.

* cited by examiner

BUILDING MANUFACTURING USING LAYERED MATERIALS

CROSS-REFERENCE TO RELATED APPLICATIONS

This application claims priority to U.S. Provisional Application No. 63/144,700, filed on Feb. 2, 2021, and entitled "BUILDING MANUFACTURING USING LAYERED MATERIALS; and to U.S. Provisional Application No. 63/240,628, filed on Sep. 3, 2021, and entitled "BUILDING MANUFACTURING USING LAYERED MATERIALS," the entire disclosures of which are hereby incorporated by reference.

FIELD

At least some embodiments disclosed herein relate generally to building construction. More specifically, at least some embodiments disclosed herein relate to building construction via layering of materials.

BACKGROUND

Current 3-D printing of buildings uses liquid materials (concrete most commonly) to "print" the building's wall components. Other methods automate the placement of bricks/blocks.

SUMMARY

In some embodiments, a kit includes a plurality of wall members. In some embodiments, each of the plurality of wall members includes an exterior surface material, an interior surface material, a protruding portion, and a channel. In some embodiments, the exterior surface material passes an accelerated weathering test simulating damage caused by outdoor weathering. In some embodiments, the interior surface material passes an environmental quality test. In some embodiments, the exterior surface material is different than the interior surface material. In some embodiments, the protruding portion of a first of the plurality of wall members is configured to be inserted into the channel of a second of the plurality of wall members. In some embodiments, the first of the plurality of wall members and the second of the plurality of wall members is configured to be stacked to form a portion of a wall of a structure. In some embodiments, the kit includes a plurality of brackets. In some embodiments, the plurality of brackets is configured to join the first of the plurality of wall members and a third of the plurality of wall members. In some embodiments, the kit includes a door.

In some embodiments, the kit includes a window. In some embodiments, the kit includes a plurality of windows.

In some embodiments, the plurality of wall members includes a release liner configured to protect the plurality of wall members during shipment of the kit.

In some embodiments, the plurality of wall members is joinable to form a roof.

In some embodiments, the kit is configured to be installed on a concrete slab.

In some embodiments, the plurality of brackets is configured to maintain the first of the plurality of wall members and the second of the plurality of wall members substantially perpendicular to each other.

In some embodiments, the exterior surface material includes wood, metal, laminates, organic materials, or combinations thereof.

In some embodiments, the interior surface material includes plaster, gypsum board, wood, stone composites, fiber cement, polymer materials, metal, inorganic materials, or combinations thereof.

In some embodiments, the plurality of wall members includes a wall member comprising a plurality of prewired electrical outlets.

In some embodiments, the kit includes a plurality of second wall members having a smaller thickness than the plurality of wall members.

In some embodiments, a kit includes a plurality of wall bodies. In some embodiments, each of the plurality of wall bodies includes an exterior groove and an interior groove. In some embodiments, the kit includes a plurality of wall panels. In some embodiments, each of the plurality of wall panels includes an exterior surface material and an insulation material. In some embodiments, the wall panels are configured to pass an accelerated weathering test simulating damage caused by outdoor weathering. In some embodiments, the plurality of wall panels is configured to be inserted into the exterior groove of each of the plurality of wall bodies. In some embodiments, the kit includes a plurality of corner brackets. In some embodiments, the plurality of corner brackets is configured to join a first of the plurality of wall bodies and a second of the plurality of wall bodies. In some embodiments, a roof bracket is configured to form a roof peak.

In some embodiments, the kit includes a door.

In some embodiments, the plurality of wall bodies includes a release liner configured to protect the plurality of wall bodies during shipment of the kit.

In some embodiments, the plurality of wall bodies is configured to form a roof.

In some embodiments, the kit is configured to be installed on a concrete slab.

In some embodiments, the kit includes a window. In some embodiments, the kit includes a plurality of windows.

In some embodiments, the plurality of corner brackets is configured to maintain the first of the plurality of wall bodies and the second of the plurality of wall bodies substantially perpendicular to each other.

In some embodiments, the exterior surface material includes wood, metal, laminates, organic materials, or combinations thereof.

In some embodiments, the kit includes a plurality of roof supports.

In some embodiments, the kit includes a subfloor.

In some embodiments, the kit includes a plurality of roof trusses.

In some embodiments, a method includes obtaining a plurality of layers of a first material. In some embodiments, the first material includes an exterior surface material and an interior surface material. In some embodiments, the exterior surface material is different than the interior surface material. In some embodiments, the exterior surface material passes an accelerated weathering test simulating damage caused by outdoor weathering. In some embodiments, the interior surface material passes an environmental quality test. In some embodiments, the method includes stacking a first layer of the plurality of layers of the first material on a second layer of the plurality of layers of the first material. In some embodiments, the method includes joining the first layer of the plurality of layers of the first material and the second layer of the plurality of layers of the first material. In some embodiments, the method includes iteratively stacking and joining the plurality of layers so as to form a building structure.

In some embodiments, the building structure is a wall, a roof, or any combination thereof.

In some embodiments, the first material is a solid material.

In some embodiments, joining the first layer of the plurality of layers of the first material and the second layer of the plurality of layers of the first material includes heating, applying an adhesive, ultrasonic welding, or any combination thereof.

In some embodiments, the exterior surface material includes wood, metal, laminates, organic materials, or combinations thereof.

In some embodiments, the interior surface material includes plaster, gypsum board, wood, stone composites, fiber cement, polymer materials, metal, inorganic materials, or combinations thereof.

In some embodiments, the method includes obtaining a layer of a second material. In some embodiments, the second material includes an exterior surface material and an interior surface material. In some embodiments, the exterior surface material of the second material is different from the interior surface material of the second material. In some embodiments, the method includes stacking the layer of the second material on one of the plurality of layers of the first material.

In some embodiments, the exterior surface material of the first material is different than the exterior surface material of the second material.

In some embodiments, the interior surface material of the first material is different than the interior surface material of the second material.

In some embodiments, an intermediate material is disposed between the interior surface material and the exterior surface material.

In some embodiments, a method includes obtaining a plurality of layers of a first material. In some embodiments, the first material includes an exterior surface material and an interior surface material. In some embodiments, the exterior surface material is different than the interior surface material. In some embodiments, the exterior surface material passes an accelerated weathering test simulating damage caused by outdoor weathering. In some embodiments, the interior surface material passes an environmental quality test. In some embodiments, the method includes stacking the plurality of layers of the first material. In some embodiments, the method includes joining the plurality of layers of the first material so as to form a building structure.

In some embodiments, the building structure is a wall, a roof, or any combination thereof.

In some embodiments, the first material is a solid material.

In some embodiments, joining the plurality of layers includes heating, applying an adhesive, ultrasonic welding, or any combination thereof.

In some embodiments, the exterior surface material includes wood, metal, laminates, organic materials, or any combination thereof.

In some embodiments, the interior surface material includes plaster, gypsum board, wood, stone composites, fiber cement, polymer materials, metal, inorganic materials, or combinations thereof.

In some embodiments, the method includes obtaining a layer of a second material. In some embodiments, the second material includes an exterior surface material and an interior surface material. In some embodiments, the exterior surface material of the second material is different from the interior surface material of the second material. In some embodiments, the method includes stacking the layer of the second material on one of the plurality of layers of the first material.

In some embodiments, the exterior surface material of the first material is different than the exterior surface material of the second material.

In some embodiments, the interior surface material of the first material is different than the interior surface material of the second material.

In some embodiments, an intermediate material is disposed between the interior surface material and the exterior surface material.

In some embodiments, a method includes obtaining a plurality of layers of a first material. In some embodiments, the first material includes an exterior surface material and an interior surface material. In some embodiments, the exterior surface material is different than the interior surface material. In some embodiments, the exterior surface material passes an accelerated weathering test simulating damage caused by outdoor weathering. In some embodiments, the interior surface material passes an environmental quality test. In some embodiments, the plurality of layers includes a channel formed therein for receiving piping. In some embodiments, the method includes stacking the plurality of layers of the first material. In some embodiments, the method includes joining the plurality of layers of the first material so as to form a building structure.

In some embodiments, the plurality of layers as stacked includes a plurality of channels.

In some embodiments, the building structure is a wall, a roof, or any combination thereof.

In some embodiments, the first material is a solid material.

In some embodiments, joining the plurality of layers includes heating, applying an adhesive, ultrasonic welding, or any combination thereof.

In some embodiments, the exterior surface material includes wood, metal, laminates, organic materials, or combinations thereof.

In some embodiments, the interior surface material includes plaster, gypsum board, wood, stone composites, fiber cement, polymer materials, metal, inorganic materials, or combinations thereof.

In some embodiments, the method includes obtaining a layer of a second material. In some embodiments, the second material includes an exterior surface material and an interior surface material. In some embodiments, the exterior surface material of the second material is different from the interior surface material of the second material. In some embodiments, the method includes stacking the layer of the second material on one of the plurality of layers of the first material.

In some embodiments, the exterior surface material of the first material is different than the exterior surface material of the second material.

In some embodiments, the interior surface material of the first material is different than the interior surface material of the second material.

In some embodiments, an intermediate material is disposed between the interior surface material and the exterior surface material.

In some embodiments, a kit includes a plurality of wall members. In some embodiments, each of the plurality of wall members includes an exterior surface material. In some embodiments, the exterior surface material passes an accelerated weathering test simulating damage caused by outdoor weathering. In some embodiments, each of the plurality of wall members include an interior surface material. In some embodiments, the interior surface material passes an environmental quality test. In some embodiments, the exterior surface material is different than the interior surface material. In some embodiments, the kit includes a plurality of brackets. In some embodiments, the plurality of brackets is configured to join a first of the plurality of wall members and a second of the plurality of wall members. In some embodiments, each of the plurality of brackets includes the exterior surface material and the interior surface material. In some embodiments, the kit includes a door.

BRIEF DESCRIPTION OF THE DRAWINGS

References are made to the accompanying drawings that form a part of this disclosure and that illustrate embodiments in which the systems and methods described in this Specification can be practiced.

Like reference numbers represent the same or similar parts throughout.

DETAILED DESCRIPTION

Labor shortages; needs for lower cost affordable housing; emergency shelters; design flexibility; and other trends in the construction industry are driving interest in automated construction methods. Generally, interest for onsite fabrication of buildings has focused on cement-based structures with the materials being mixed and extruded as a viscous liquid in a layer-by-layer process. This method creates significant limitations on structure and design, finishes, material properties, selection of materials, or use of multi materials, and installation temperature and conditions. This method also precludes many common and desirable building materials, as well as potentially desirable materials such as plastics, synthetics, natural materials, recycled materials, or reclaimed materials.

Embodiments of this disclosure utilize layers of material, including plastic, asphalt-based materials, foamed/expanded materials with water impermeable surfaces or filled with a reinforcing material/resin, "solid surface" synthetics, wood and wood fiber based materials, cement and fiber cement, gypsum-based materials, composites (continuous fiber, chopped fiber, woven/scrim, or particulate reinforced plastics), metal, and combinations thereof, that can be cut to length (as they are laminated or before lamination) on the construction site and then laminated together to form a building structure (e.g., a wall, roof, combination thereof, or the like). A thickness of the materials may be selected to provide the resolution or physical properties needed for that building structure. The layers are joinable and may be joined by heating (hot air, radiant heating, etc.), fasteners, adhesives, or interlocking joints designed into the layers. The structures produced may be made from one or more of these and similar materials.

The shift to continuous/long strips of solid materials instead of a viscous liquid or conventional bricks can allow both desirable exterior and interior materials to be used together in each layer of the building structure. In some embodiments, this can result in less waste as if a strip is insufficient to complete a building structure. The materials can be provided in strip form or rolls depending upon the brittleness or flexibility of the materials. Additionally, allowing heat or adhesive joining of the layers can result in an immediately "finished" structure that does not require setting or cure time as in prior methods.

Figure 1:
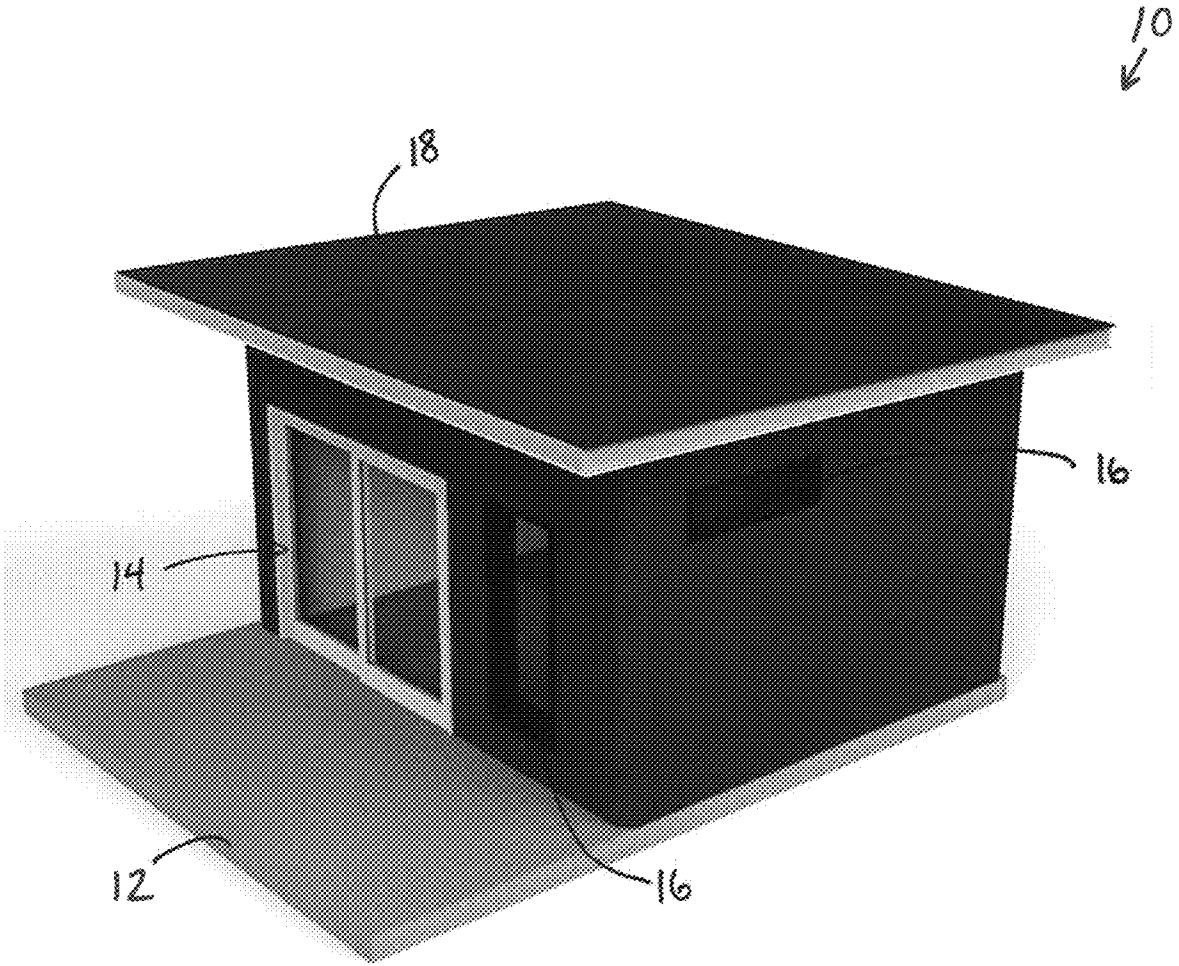
FIG. 1 shows a structure, according to some embodiments.

FIG. 1 shows a structure 10, according to some embodiments. The structure 10 can be, for example, a house, an office space, or the like. The particular use for the structure 10 can vary beyond the stated list and is not intended to be limiting.

As illustrated, the structure 10 is built on a concrete slab 12. In some embodiments, the structure 10 can be built on a surface other than concrete.

The structure 10 can be assembled from a kit, as shown and described in additional detail in accordance with FIGS. 2-7 below. As illustrated, the structure 10 includes a door 14 and a plurality of windows 16. It is to be appreciated that the door 14 can be a different style of door (e.g., a hinged door instead of a sliding door). In some embodiments, the structure 10 may not include the windows 16 or may include a different configuration (e.g., size, location, style, etc.) of windows 16.

The structure 10 includes a roof 18. In some embodiments, the roof 18 can be coated with a waterproof membrane. In some embodiments, the roof 18 can be covered with roofing shingles. As illustrated, the roof 18 includes a flat pitch roof. In some embodiments, the roof 18 can alternatively be pitched so that, for example, the roof 18 rises a selected vertical amount over its horizontal span and, for example, water can run from the roof 18.

Figure 2:
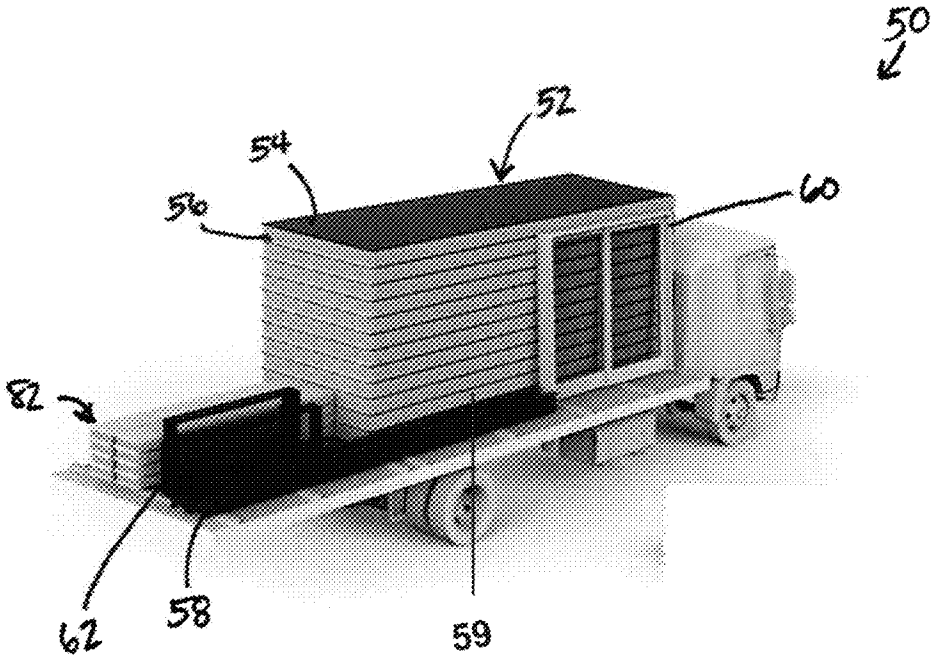
FIG. 2 shows a kit that can be used to build the structure of FIG. 1, according to some embodiments.

FIG. 2 shows a kit 50 that can be used to build the structure 10 (FIG. 1), according to some embodiments.

The kit 50 includes a plurality of wall members 52. The wall members 52 can be referred to as a composite material. In some embodiments, the wall members 52 include an exterior surface material 54 and an interior surface material 56. In some embodiments, the wall members 52 include the exterior surface material 54, the interior surface material 56, and a material disposed therebetween. In some embodiments, the exterior surface material 54 is different than the interior surface material 56. In some embodiments, the wall members 52 can include a release liner 59 configured to protect the wall members 52 during shipment of the kit 50.

In some embodiments, the exterior surface material 54 passes an accelerated weathering test simulating damage caused by outdoor weathering. In some embodiments, an accelerated weathering test includes, but is not limited to, ASTM G0155-05A, ASTM D6878-08, and any combination thereof.

In some embodiments, the interior surface material 56 passes an environmental quality test. In some embodiments, the environmental quality test can include, but is not limited to, a test relating to the appearance of the interior surface material 56 (e.g., an L.A.B. color test or the like), a test relating to the ability of the interior surface material 56 to resist mold on surfaces thereof (e.g., ASTM D3273), any combination thereof, or the like.

In some embodiments, the plurality of wall members 52 can be used to form exterior walls of the structure 10 (FIG. 1). In some embodiments, the wall members 52 are joinable to form a wall. In some embodiments, the wall members 52 are joinable to form a roof of the structure 10 (FIG. 1). In some embodiments, the plurality of wall members 52 can be used to add on to an existing structure which can be similar to the structure 10 (FIG. 1). For example, in some embodiments, the plurality of wall members 52 can be used to form an addition or to replace a portion of an existing structure.

In some embodiments, the wall members 52 can be a solid material. For example, the wall members 52 can be already cured or solidified. As such, unlike prior methods, the wall members 52 is not applied in a liquid form onsite and then cured. In some embodiments, the wall members 52 can be in a strip form. In some embodiments, the wall members 52 can be flexible such that it is rolled into a rolled form. In some embodiments, the wall members 52 may have a length at manufacturing that can be customized at a building site. For example, the wall members 52 can be manufactured to be 10 feet in length and trimmed down to, for example, 8 feet at a building site prior to installation.

In some embodiments, the exterior surface material 54 can include wood; metal; laminates; organic materials; or any combination thereof.

In some embodiments, the wood can include lumber; particle board; plywood; glued laminates; cross-laminated timber; or any combination thereof.

In some embodiments, metal can include steel; iron-based (non-steel) metals; aluminum based metals; copper-based metals; nickel-based metals; other suitable metals; or any combination thereof. In some embodiments, steel can include stainless steel; surface treated steel; or any combination thereof. In some embodiments, surface treated steel can include galvanized steel; Galvalume® steel; other surface treated steels; or any combination thereof.

In some embodiments, laminates include any combination of polymers with metal; composites; inorganic materials; or any combination thereof. In some embodiments, laminates can be polymer based. In some embodiments, polymer based laminates include polymers laminated with wood; with metal; with other polymers; with synthetic composites; with inorganic materials; or any combination thereof. In some embodiments, inorganic materials include stone; cement; mortar; fiber cement; or any combination thereof.

In some embodiments, organic materials include polymers; plant-based resins; composites; or any combination thereof. In some embodiments, polymers include polyethylene; polypropylene; polycarbonate; epoxy; urethane; polyethylene terephthalate; polystyrene; asphaltic or bitumen based polymers; plastics; thermoplastics; thermosets; silicones; acrylates; silane-terminated polymers; other hybrid polymers; or any combination thereof. In some embodiments, urethanes include urethanes having renewable or natural polyol. In some embodiments, plant-based resins include urethane; tall oil pitch; or any combination thereof. In some embodiments, composites include renewable or natural fibers; renewable or natural particulates; particulates; or any combination thereof. In some embodiments, renewable or natural fibers include grass-based fibers; stalk-based fibers; seed or fruit fibers; leaf fibers; stem fibers; wood fibers; or any combination thereof. In some embodiments, particulates include wood dust; minerals; rice hull; stone; recycled particulates; glass; or any combination thereof.

In some embodiments, the interior surface material 56 can have a first thickness and a first width. In some embodiments, the exterior surface material 54 can have a second thickness and a second width. In some embodiments, the first thickness and the second thickness can be different. In some embodiments, the first width and the second width can be different. In some embodiments, the first thickness, the second thickness, or combinations thereof, can be from 0.001 inches to 6 inches. It is to be appreciated that these numbers are examples and that the first thickness, the second thickness, or combinations thereof can be thicker than 6 inches. The first thickness, the second thickness, or combinations thereof, may be selected based on a combination of the materials selected and the function of the wall members 52.

In some embodiments, the interior surface material 56 can have a first length and the exterior surface material 54 can have a second length. In some embodiments, the first length and the second length can be different. In some embodiments, the first length and the second length can be the same.

In some embodiments, the interior surface material 56 can include plaster; gypsum board; wood; composites; fiber cement; polymers; metals; inorganics; or any combination thereof. In some embodiments, inorganics can include cement; mortar; or any combination thereof.

In some embodiments, an intermediate material may be disposed between the interior surface material 56 and the exterior surface material 54. In some embodiments, the intermediate materials include foam; honeycomb; truss or expanded structures; thermal insulation; air or moisture barriers; any combination thereof, or the like.

In some embodiments, a number of the plurality of wall members 52 can vary depending upon a total height of a wall being built. For example, in some embodiments, the plurality of wall members 52 can be joined to form a wall using two of the plurality of wall members 52, using three of the plurality of wall members 52, using four of the plurality of wall members 52, using five of the plurality of wall members 52, using six of the plurality of wall members 52, using seven of the plurality of wall members 52, or using eight or more of the plurality of wall members 52.

The kit 50 includes a plurality of brackets 58. In some embodiments, the plurality of brackets 58 is configured to join a first of the plurality of wall members 52 and a second of the plurality of wall members 52. In some embodiments, each of the plurality of brackets 58 includes the exterior surface material 54 and the interior surface material 56. As a result, the brackets 58 may appear visually similar to the wall members 52. The brackets 58 may function to maintain the first of the wall members 52 substantially perpendicular to the second of the wall members 52 for building the structure 10 (FIG. 1).

The kit 50 includes a door 60. As illustrated, the kit 50 includes a plurality of windows 62. It is to be appreciated that the plurality of windows 62 are optional and may not be included with the kit 50. In some embodiments, the kit 50 may include additional windows 62.

It is to be appreciated that a number of wall members 52 and brackets 58 can vary according to the design of the structure (e.g., structure 10 of FIG. 1) being built.

Figure 3:
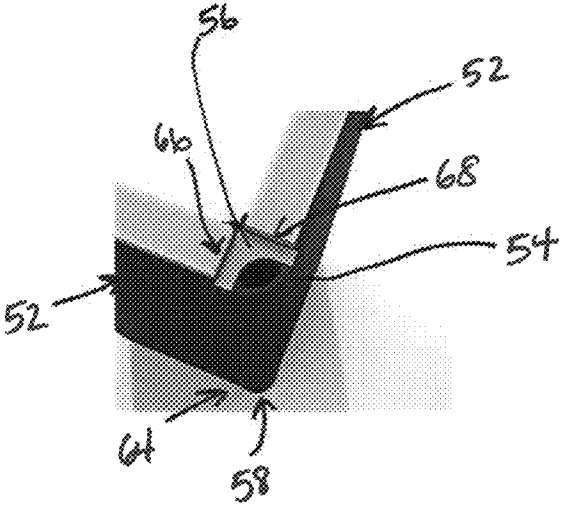
FIG. 3 shows a partial view of brackets of the kit of FIG. 2 in an installed configuration, according to some embodiments.

FIG. 3 shows a partial view of the brackets 58 in an installed configuration, according to some embodiments. The brackets 58 include the exterior surface material 54 and the interior surface material 56. As a result, the materials from the wall members 52 are continuous, even in the corners of the structure 10 (FIG. 1). This can, for example, provide a better aesthetic.

In some embodiments, an outer surface 64 of the brackets 58 can be curved. In some embodiments, the outer surface 64 can be a shape other than curved. For example, in some embodiments, the outer surface 64 can substantially form a right angle. As used herein, substantially forming a right angle includes a right angle subject to, for example, manufacturing tolerances or the like. In some embodiments, this can include 90° and within plus or minus 15° from 90° (e.g., 750 to 105°).

In some embodiments, the brackets 58 form channels 66, 68. The channels 66, 68 are oriented substantially perpendicularly to each other. As used herein, substantially perpendicularly includes perpendicular subject to, for example, manufacturing tolerances or the like. In some embodiments, this can include within plus or minus 15° from perpendicular. The channels 66, 68 are configured to receive an end of the wall members 52. A portion of the wall members 52 is maintained within the channels 66, 68, which can hold the wall members 52 in the installed configuration, thereby forming walls of the structure 10 (FIG. 1). In some embodiments, during installation, a first of the brackets 58 can be installed at a corner of the structure 10 (FIG. 1) and the wall members 52 installed to the first of the brackets 58. After installing at least some of the wall members 52 to the first of the brackets 58, a second of the brackets 58 can be installed at an opposite end of the wall members 52. In some embodiments, the first of the brackets 58 can be made of aluminum. In some embodiments, the first of the brackets 58 can have a length that corresponds to an overall height of a wall being built. In some embodiments, the first of the brackets 58 can have a length that corresponds to a size of each of the wall members 52.

Figure 4:
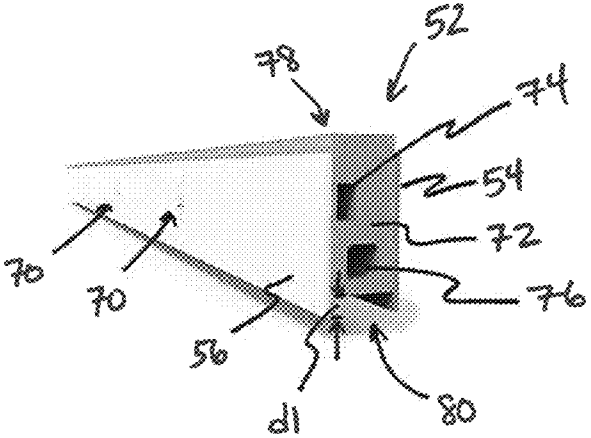
FIG. 4 shows a view of one of the wall members of the kit of FIG. 2, according to some embodiments.

FIG. 4 shows a view of one of the wall members 52, according to some embodiments. The wall members 52 in the illustrated embodiment are configured with a prewired electrical outlet 70. It is to be appreciated that the illustrated one of the wall members 52 may be used as one or more of the wall members 52 in the structure 10 (FIG. 1), but not all of the wall members 52. That is, others of the wall members 52 may not include the prewired electrical outlet 70. Additionally, the illustrated example is a prewired electrical outlet 70. It is to be appreciated that the electrical outlet can alternatively be a different type of outlet such as, but not limited to, an ethernet outlet, a vacuum outlet, a heating, ventilation, air conditioning, and refrigeration (HVACR) outlet, any combination thereof, water or other plumbing outlet, or the like. In the illustrated embodiment, a plurality of prewired electrical outlets 70 is shown. This can be, for example, based on a building code, a preference, or the like.

The wall members 52 includes the exterior surface material 54 and the interior surface material 56 separated by an intermediate material 72. The intermediate material 72 can be, for example, insulation or the like. In some embodiments, the intermediate material 72 can include foam; honeycomb; truss or expanded structures; thermal insulation; air or moisture barriers; any combination thereof, or the like.

A first channel 74 and a second channel 76 are formed in the intermediate material 72. The first channel 74 and the second channel 76 can be used to enable wiring for the prewired electrical outlet 70 or for other features to be hidden within the wall members 52.

As illustrated, the wall members 52 include a protruding portion 78 and a channel 80. The protruding portion 78 can be a portion of the intermediate material 72 that is not covered by the exterior surface material 54 or the interior surface material 56 for a given one of the wall members 52. The channel 80 is formed between the exterior surface material 54 and the interior surface material 56 for the given one of the wall members 52. In some embodiments, the intermediate material 72 can be offset a distance d1 from the exterior surface material 54 and the interior surface material 56 to form the protruding portion 78 and the channel 80. The 78 and the 80 enable the wall members 52 to be stackable to form walls of the structure 10 (FIG. 1) or the roof of the structure 10 (FIG. 1) so that the wall members 52 nest with each other to provide a more secure fit between the wall members 52 when installed.

Figure 5:
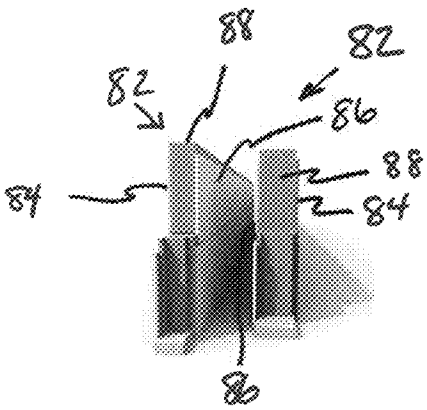
FIG. 5 shows a view of another one of the wall members of the kit of FIG. 2, according to some embodiments.

FIG. 5 shows a view of a wall member 82, according to some embodiments. The wall members 82 can include features that are the same as or similar to the wall members 52 of FIGS. 2-4. Unlike the wall members 52, the wall member 82 can include a first interior surface material 84 and a second interior surface material 86 separated by an intermediate material 88.

The wall member 82 can be used to form an interior wall within the structure 10 (FIG. 1). As such, the wall member 82 may also have a different thickness than the wall members 52. In some embodiments, the wall member 82 can have a smaller thickness than the wall members 52.

In some embodiments, the first interior surface material 84 can have a first thickness and a first width. In some embodiments, the second interior surface material 86 can have a second thickness and a second width. In some embodiments, the first thickness and the second thickness can be different. In some embodiments, the first width and the second width can be different. In some embodiments, the first thickness, the second thickness, or combinations thereof, can be from 0.001 inches to 2 inches. It is to be appreciated that these numbers are examples and that the first thickness, the second thickness, or combinations thereof can be thicker than 2 inches. The first thickness, the second thickness, or combinations thereof, may be selected based on a combination of the materials selected and the function of the wall member 82.

In some embodiments, the first interior surface material 84 can have a first length and the second interior surface material 86 can have a second length. In some embodiments, the first length and the second length can be different. In some embodiments, the first length and the second length can be the same.

In some embodiments, the first interior surface material 84 or the second interior surface material 86 can include plaster; gypsum board; wood; composites; fiber cement;

polymers; metals; inorganics; or any combination thereof. In some embodiments, inorganics can include cement; mortar; or any combination thereof.

In some embodiments, an intermediate material may be disposed between the first interior surface material 84 and the second interior surface material 86. In some embodiments, the intermediate materials include foam; honeycomb; truss or expanded structures; thermal insulation; air or moisture barriers; any combination thereof, or the like.

Figure 6:
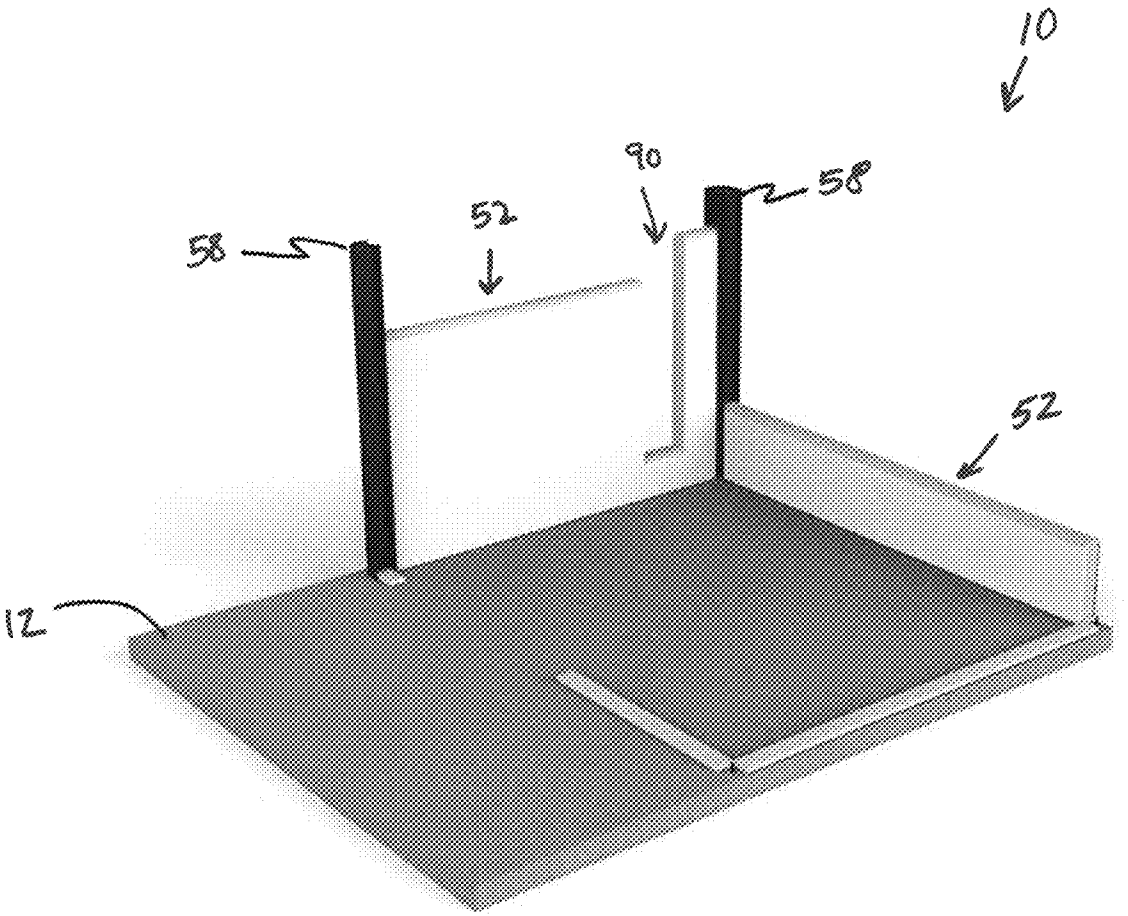
FIG. 6 shows a view of the structure of FIG. 1 in a partially completed state, according to some embodiments.

FIG. 6 shows a view of a partially completed structure 10, according to some embodiments. The structure 10 includes a plurality of the wall members 52 stacked and installed along with a plurality of the brackets 58. As can be seen, an opening 90 for a window is shown on one of the walls. To form the opening 90, the wall members 52 can be trimmed to a desired length on site of the building of the structure 10.

Figure 7:
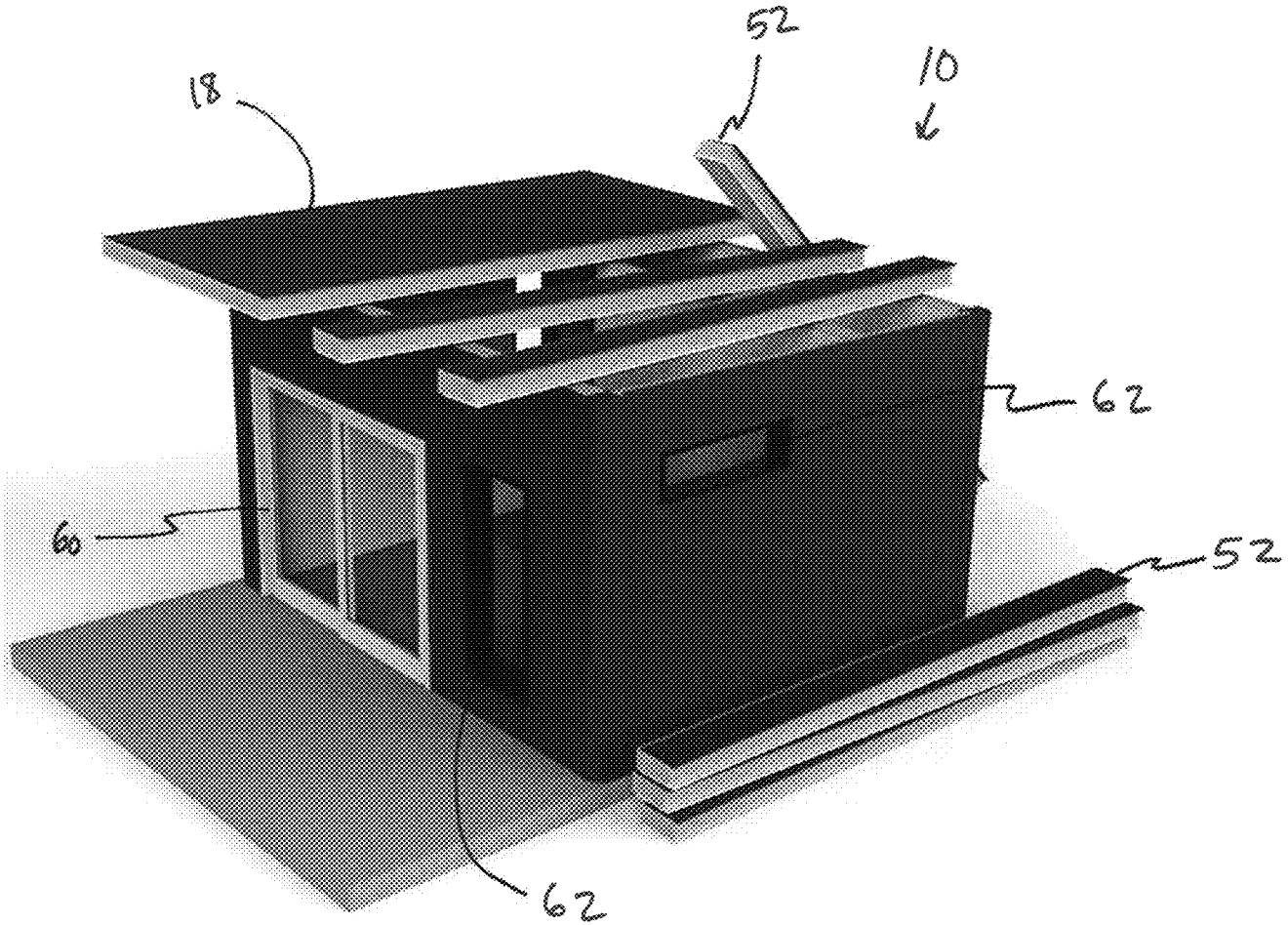
FIG. 7 shows a view of the structure of FIG. 1 in a partially completed state, according to some embodiments.

FIG. 7 shows another view of the partially completed structure 10, according to some embodiments. As shown in the illustrated embodiment, the door 60 and windows 62 are installed in the structure 10. The plurality of wall members 52 are being installed to form the roof 18 of the structure 10.

Figure 8:
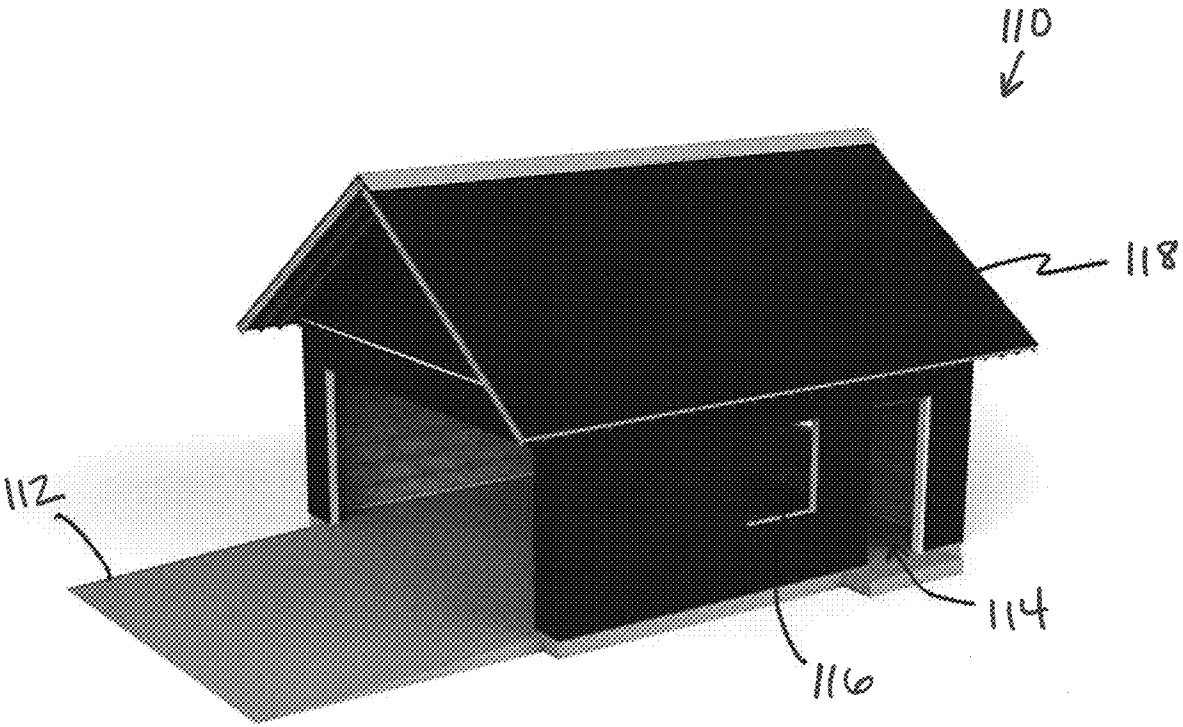
FIG. 8 shows a structure, according to some embodiments.

FIG. 8 shows a structure 110, according to some embodiments. The structure 110 can be, for example, a house, an office space, or the like. The particular use for the structure 110 can vary beyond the stated list and is not intended to be limiting.

As illustrated, the structure 110 is built on a concrete slab 112. In some embodiments, the structure 110 can be built on a surface other than concrete.

The structure 110 can be assembled from a kit, as shown and described in additional detail in accordance with FIGS. 9-13 below. As illustrated, the structure 110 includes a doorway 114 and a window opening 116. It is to be appreciated that the doorway 114 can accommodate various styles of doors. In some embodiments, the structure 110 may not include the window opening 116 or may include a different configuration (e.g., size, location, style, etc.) of the window opening 116.

The structure 110 includes a roof 118. In some embodiments, the roof 118 can be covered with roofing shingles.

Figure 9:
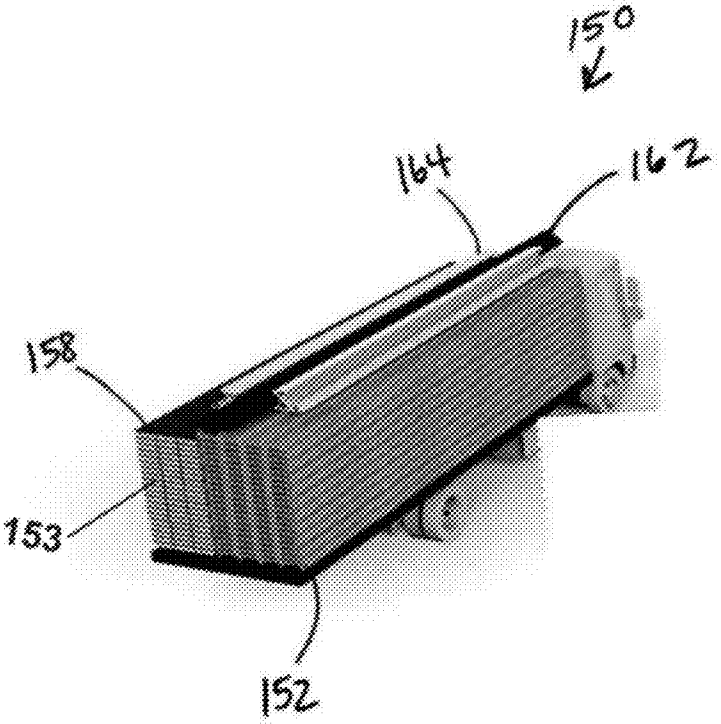
FIG. 9 shows a kit that can be used to build the structure of FIG. 8, according to some embodiments.

FIG. 9 shows a kit 150 that can be used to build the structure 110 of FIG. 8, according to some embodiments.

The kit 150 includes a plurality of wall bodies 152. The wall bodies 152 can have an H-shape. The wall bodies 152 can be stacked to form the walls of the structure 110 (FIG. 8). In some embodiments, the plurality of wall bodies 152 can be used to add on to an existing structure which can be similar to the structure 110 (FIG. 8). For example, in some embodiments, the plurality of wall bodies 152 can be used to form an addition or to replace a portion of an existing structure.

In some embodiments, the wall bodies 152 can be made of wood; metal; laminates; organic materials; or any combination thereof. In some embodiments, the wall bodies 152 can include a release liner 153 configured to protect the wall bodies 152 during shipment of the kit 150.

In some embodiments, the wood can include lumber; particle board; plywood; glued laminates; cross-laminated timber; or any combination thereof.

In some embodiments, metal can include steel; iron-based (non-steel) metals; aluminum based metals; copper-based metals; nickel-based metals; other suitable metals; or any combination thereof. In some embodiments, steel can include stainless steel; surface treated steel; or any combination thereof. In some embodiments, surface treated steel can include galvanized steel; Galvalume® steel; other surface treated steels; or any combination thereof.

In some embodiments, laminates include any combination of polymers with metal; composites; inorganic materials; or any combination thereof. In some embodiments, laminates can be polymer based. In some embodiments, polymer based laminates include polymers laminated with wood; with metal; with other polymers; with synthetic composites; with inorganic materials; or any combination thereof. In some embodiments, inorganic materials include stone; cement; mortar; fiber cement; or any combination thereof.

In some embodiments, organic materials include polymers; plant-based resins; composites; or any combination thereof. In some embodiments, polymers include polyethylene; polypropylene; polycarbonate; epoxy; urethane; polyethylene terephthalate; polystyrene; asphaltic or bitumen based polymers; plastics; thermoplastics; thermosets; silicones; acrylates; silane-terminated polymers; other hybrid polymers; or any combination thereof. In some embodiments, urethanes include urethanes having renewable or natural polyol. In some embodiments, plant-based resins include urethane; tall oil pitch; or any combination thereof. In some embodiments, composites include renewable or natural fibers; renewable or natural particulates; particulates; or any combination thereof. In some embodiments, renewable or natural fibers include grass-based fibers; stalk-based fibers; seed or fruit fibers; leaf fibers; stem fibers; wood fibers; or any combination thereof. In some embodiments, particulates include wood dust; minerals; rice hull; stone; recycled particulates; glass; or any combination thereof.

The kit 150 includes a roof bracket 162. The roof bracket 162 is configured for use in forming a peak of the roof 118 (FIG. 8) of the structure 110 (FIG. 8).

In some embodiments, the kit 150 includes a door. In some embodiments, the kit includes one or more windows. In some embodiments, the kit 150 includes a garage door.

In some embodiments, the kit 150 includes a plurality of roof supports 164. The roof supports 164 may be installed on a top of a wall of the structure 110 (FIG. 8) to enable the wall bodies 152 to be installed to form the roof 118 (FIG. 8) of the structure 110 (FIG. 8).

Figure 10:
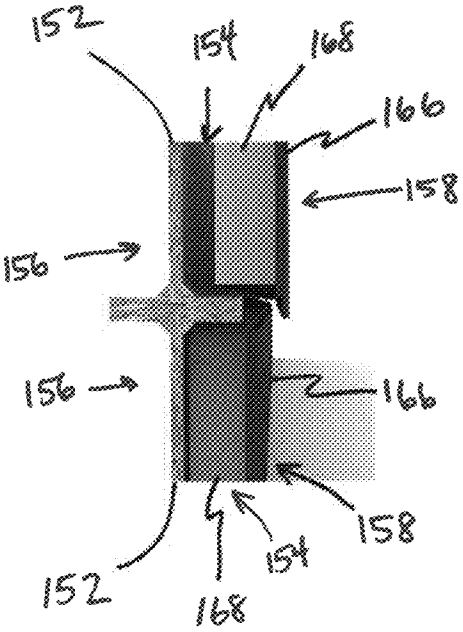
FIG. 10 shows a side view of the wall bodies and wall panels of FIG. 9, according to some embodiments.

FIG. 10 shows a side view of the wall bodies 152 and wall panels 158, according to some embodiments.

The wall bodies 152 include an exterior groove 154 and an interior groove 156. A plurality of wall panels 158 can be inserted into the exterior groove 154 of the wall bodies 152. A plurality of wall panels can be inserted into the interior groove 156. The plurality of wall panels inserted into the interior groove 156 can be optional.

The wall panels 158 include an exterior surface material 166 and a second material 168. In some embodiments, the second material 168 can be, for example, an insulative material.

In some embodiments, the exterior surface material 166 can include wood; metal; laminates; organic materials; or any combination thereof.

In some embodiments, the wood can include lumber; particle board; plywood; glued laminates; cross-laminated timber; or any combination thereof.

In some embodiments, metal can include steel; iron-based (non-steel) metals; aluminum based metals; copper-based metals; nickel-based metals; other suitable metals; or any combination thereof. In some embodiments, steel can include stainless steel; surface treated steel; or any combination thereof. In some embodiments, surface treated steel can include galvanized steel; Galvalume® steel; other surface treated steels; or any combination thereof.

In some embodiments, laminates include any combination of polymers with metal; composites; inorganic materials; or any combination thereof. In some embodiments, laminates can be polymer based. In some embodiments, polymer based laminates include polymers laminated with wood; with metal; with other polymers; with synthetic composites; with inorganic materials; or any combination thereof. In some embodiments, inorganic materials include stone; cement; mortar; fiber cement; or any combination thereof.

In some embodiments, organic materials include polymers; plant-based resins; composites; or any combination thereof. In some embodiments, polymers include polyethylene; polypropylene; polycarbonate; epoxy; urethane; polyethylene terephthalate; polystyrene; asphaltic or bitumen based polymers; plastics; thermoplastics; thermosets; silicones; acrylates; silane-terminated polymers; other hybrid polymers; or any combination thereof. In some embodiments, urethanes include urethanes having renewable or natural polyol. In some embodiments, plant-based resins include urethane; tall oil pitch; or any combination thereof. In some embodiments, composites include renewable or natural fibers; renewable or natural particulates; particulates; or any combination thereof. In some embodiments, renewable or natural fibers include grass-based fibers; stalk-based fibers; seed or fruit fibers; leaf fibers; stem fibers; wood fibers; or any combination thereof. In some embodiments, particulates include wood dust; minerals; rice hull; stone; recycled particulates; glass; or any combination thereof.

In some embodiments, the second material 168 may be disposed adjacent to the exterior surface material 166. In some embodiments, the second material 168 can include foam; honeycomb; truss or expanded structures; thermal insulation; air or moisture barriers; any combination thereof, or the like.

In the illustrated embodiment, the second material 168 is sized to fit within the exterior groove 154 and the exterior surface material 166 is disposed adjacent to the exterior groove 154. Additionally, the exterior surface material 166 is sized so that a portion of a first exterior surface material 166 overlaps a portion of a second exterior surface material 166 when the wall panels 158 are installed in the wall bodies 152. In some embodiments, a portion of the first exterior surface material 166 can be secured to the 152 via fasteners such as, but not limited to, nails, screws, bolts, or the like, before inserting an overlapping second exterior surface material 166.

Figure 11:
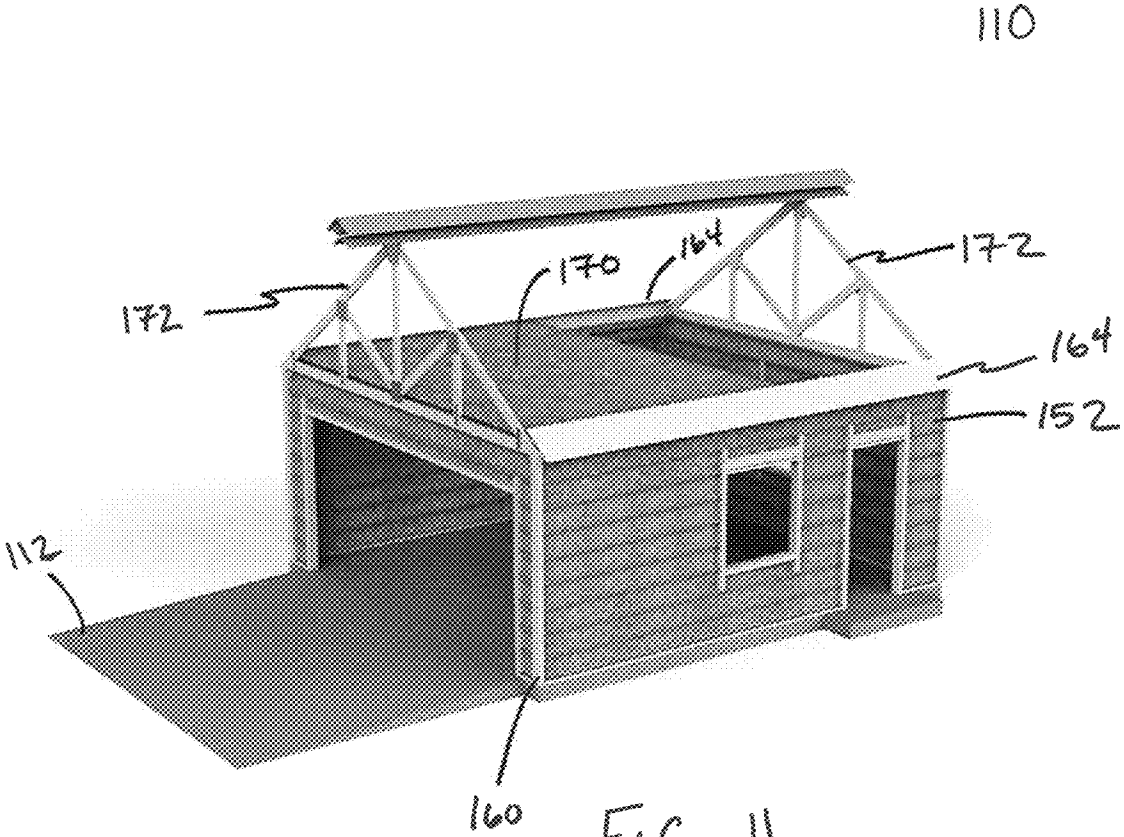
FIG. 11 shows a view of the structure of FIG. 8 as partially completed, according to some embodiments.

FIG. 11 shows a view of a partially completed structure 110 of FIG. 8, according to some embodiments. The structure 110 includes the wall bodies 152 stacked and installed on the concrete slab 112. The partially completed structure 110 includes openings formed in the wall bodies 152 for a window, a door, and a garage door. It is to be appreciated that these openings can be selected based on a type of structure being built. Thus, in some embodiments, one or more of the openings may not be included and, in some embodiments, one or more additional openings may be included.

A plurality of brackets 160 can be used for creating the structure 110. In some embodiments, the brackets 160 can be made of the same materials as the wall bodies 152 or the wall panels 158. In some embodiments, the brackets 160 can include typical framing materials such as, but not limited to, lumber or the like.

As shown in the illustrated embodiment, in some embodiments, the structure 110 can include a subfloor 170. In some embodiments, the subfloor 170 can, for example, create an attic or loft space within the structure 110. It is to be appreciated that the subfloor 170 is not required and may not be included depending upon a design of the structure 110.

As shown in FIG. 11, the kit 150 (FIG. 9) can include a plurality of roof trusses 172. The illustrated embodiment includes two roof trusses 172. It is to be appreciated that the number of roof trusses 172 can vary beyond the shown number. For example, the structure 110 (FIG. 8) can include three, four, or more of the roof trusses 172. The number of the roof trusses 172 can be selected based on, for example, an overall size of the structure 110 (FIG. 8). In some embodiments, the roof trusses 172 may not be part of the kit 150 (FIG. 9).

Figure 12:
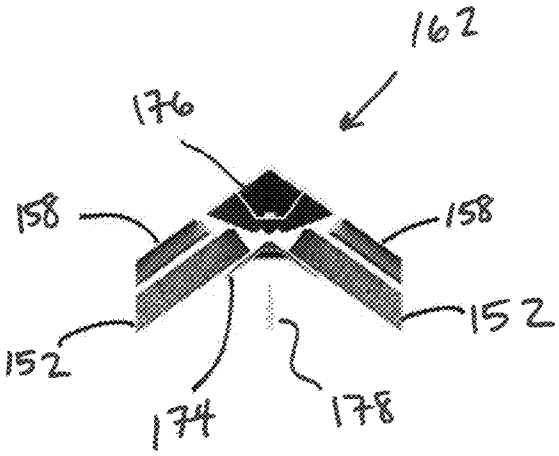
FIG. 12 shows an exploded side view of the roof bracket of FIG. 9, according to some embodiments.

FIG. 12 shows an exploded side view of the roof bracket 162, according to some embodiments. The roof bracket 162 can include a first member 174 and a second member 176. The first member 174 and the second member 176 can each be a single piece that extends the length of the roof 118 (FIG. 8) of the structure 110 (FIG. 8). In some embodiments, the length of the first member 174 and the second member 176 can be selected to span from a first of the roof trusses 172 to a second of the roof trusses 172.

The first member 174 can be installed so that the first member 174 rests on a surface of the roof trusses 172. The wall bodies 152 can be placed on the roof so that a first end of the wall bodies 152 rests on the roof supports 164 and a second end of the wall bodies 152 rests on the first member 174. Once all of the wall bodies 152 are aligned on the roof 118 (FIG. 8), the wall panels 158 can be inserted into the exterior groove 154 of each of the wall bodies 152. Then, the second member 176 can be aligned over the first member 174 so that the first member 174 and the second member 176 sandwich the wall bodies 152 and the wall panels 158. The first member 174 can then be secured to the second member 176 via, for example, a plurality of fasteners 178 such as, but not limited to, bolts, nails, screws, or the like. In some embodiments, the fasteners 178 can be driven from an interior of the roof bracket 162 toward the exterior of the roof bracket 162. That is, from the first member 174 toward the second member 176.

Figure 13:
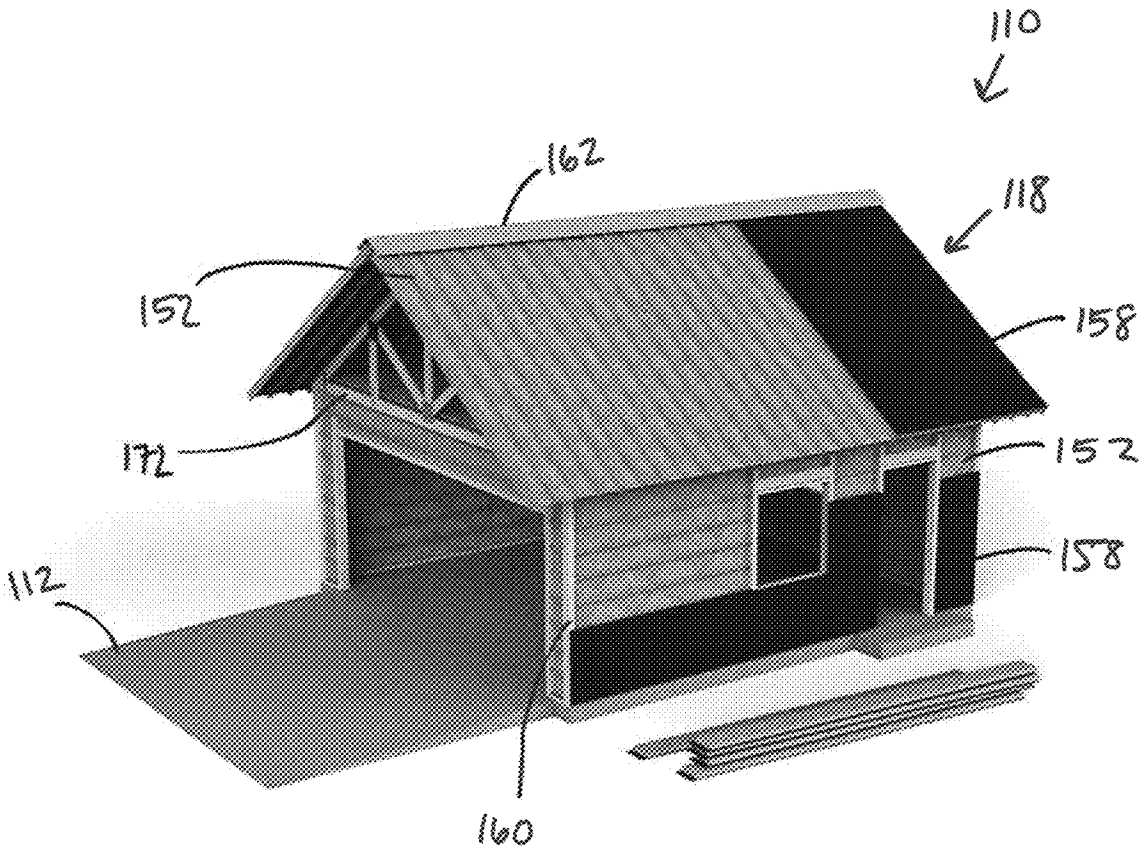
FIG. 13 shows another view of the structure of FIG. 8 as partially completed, according to some embodiments.

FIG. 13 shows another view of a partially completed structure 110 of FIG. 8, according to some embodiments. In the illustrated embodiment, the structure 110 has generally been formed via the wall bodies 152 and openings for a window, door, and garage door have been framed. Additionally, the wall panels 158 have been installed in some of the exterior grooves 154 (not shown) of the wall bodies 152.

Figure 14:
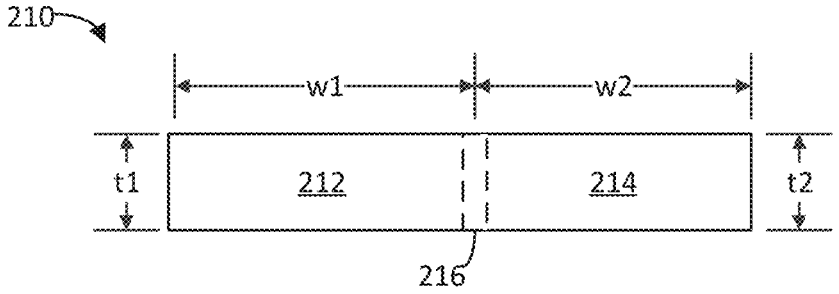
FIG. 14 illustrates a first material, according to some embodiments.

FIG. 14 illustrates a material 210, according to some embodiments. The material 210 may be referred to as a composite material as the material 210 includes a first material, interior surface material 212, and a second material, exterior surface material 214. In some embodiments, the interior surface material 212 passes an environmental quality test. In some embodiments, the environmental quality test can include, but is not limited to, a test relating to the appearance of the interior surface material 212 (e.g., an L.A.B. color test or the like), a test relating to the ability of the interior surface material 212 to resist mold on surfaces thereof (e.g., ASTM D3273), any combination thereof, or the like. In some embodiments, the exterior surface material 214 passes one or more accelerated weathering tests simulating damage caused by outdoor weathering. In some embodiments, an accelerated weathering test includes, but is not limited to, ASTM G0155-05A, ASTM D6878-08, and any combination thereof.

In some embodiments, the material 210 can be a solid material. For example, the material 210 can be already cured or solidified. As such, unlike prior methods, the material 210 is not applied in a liquid form onsite and then cured. In some embodiments, the material 210 can be in a strip form. In some embodiments, the material 210 can be flexible such that it is rolled into a rolled form. In some embodiments, the material 210 may have a length at manufacturing that can be customized at a building site. For example, the material 210 can be manufactured to be 10 feet in length and trimmed down to, for example, 8 feet at a building site prior to installation.

In some embodiments, the interior surface material 212 can have a thickness t1 and a width w1. In some embodiments, the exterior surface material 214 can have a thickness t2 and a width w2. In some embodiments, the thickness t1 and the thickness t2 can be different. In some embodiments, the width w1 and the width w2 can be different. In some embodiments, the thickness t1, the thickness t2, or combinations thereof, can be from 0.001 inches to 6 inches. It is to be appreciated that these numbers are examples and that the thickness t1, the thickness t2, or combinations thereof can be thicker than 6 inches. The thickness t1, the thickness t2, or combinations thereof, may be selected based on a combination of the materials selected and the function of the material 210.

In some embodiments, the interior surface material 212 can have a first length (into or out of the page) and the exterior surface material 214 can have a second length (into or out of the page). In some embodiments, the first length and the second length can be different.

In some embodiments, the interior surface material 212 can include plaster; gypsum board; wood; composites; fiber cement; polymers; metals; inorganics; or any combination thereof. In some embodiments, inorganics can include cement; mortar; or any combination thereof.

In some embodiments, the exterior surface material 214 can include wood; metal; laminates; organic materials; or any combination thereof.

In some embodiments, the wood can include lumber; particle board; plywood; glued laminates; cross-laminated timber; or any combination thereof.

In some embodiments, metal can include steel; iron-based (non-steel) metals; aluminum based metals; copper-based metals; nickel-based metals; other suitable metals; or any combination thereof. In some embodiments, steel can include stainless steel; surface treated steel; or any combination thereof. In some embodiments, surface treated steel can include galvanized steel; Galvalume® steel; other surface treated steels; or any combination thereof.

In some embodiments, laminates include any combination of polymers with metal; composites; inorganic materials; or any combination thereof. In some embodiments, laminates can be polymer based. In some embodiments, polymer based laminates include polymers laminated with wood; with metal; with other polymers; with synthetic composites; with inorganic materials; or any combination thereof. In some embodiments, inorganic materials include stone; cement; mortar; fiber cement; or any combination thereof.

In some embodiments, organic materials include polymers; plant-based resins; composites; or any combination thereof. In some embodiments, polymers include polyethylene; polypropylene; polycarbonate; epoxy; urethane; polyethylene terephthalate; polystyrene; asphaltic or bitumen based polymers; plastics; thermoplastics; thermosets; silicones; acrylates; silane-terminated polymers; other hybrid polymers; or any combination thereof. In some embodiments, urethanes include urethanes having renewable or natural polyol. In some embodiments, plant-based resins include urethane; tall oil pitch; or any combination thereof. In some embodiments, composites include renewable or natural fibers; renewable or natural particulates; particulates; or any combination thereof. In some embodiments, renewable or natural fibers include grass-based fibers; stalk-based fibers; seed or fruit fibers; leaf fibers; stem fibers; wood fibers; or any combination thereof. In some embodiments, particulates include wood dust; minerals; rice hull; stone; recycled particulates; glass; or any combination thereof.

In some embodiments, an intermediate material 216 may be disposed between the interior surface material 212 and the exterior surface material 214. In some embodiments, the intermediate materials include foam; honeycomb; truss or expanded structures; thermal insulation; air or moisture barriers; any combination thereof, or the like.

Figure 15:
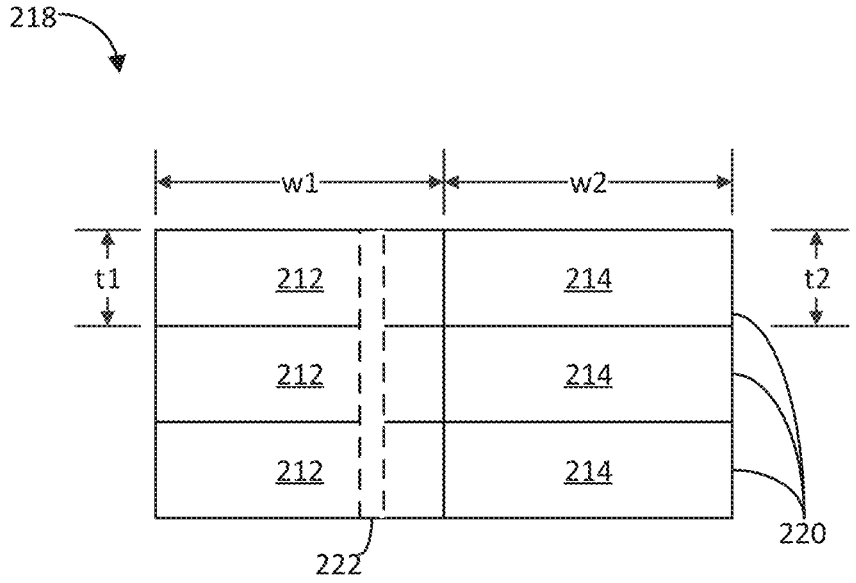
FIG. 15 illustrates a plurality of the first material of FIG. 14 in a stacked configuration, according to some embodiments.

FIG. 15 illustrates a building structure 218 including the material 210 of FIG. 14 in a stacked configuration, according to some embodiments. In some embodiments, the building structure 218 can be a wall of a building. In some embodiments, the building structure 218 can be a roof of a building.

In some embodiments, a plurality of layers 220 of the material 210 can be joined (e.g., a first layer with a second layer and a third layer). In some embodiments the plurality of layers 220 can be joined using adhesives; fasteners; thermal joining; ultrasonic joining; or any combination thereof.

In some embodiments, an adhesive can be a glue or the like. In some embodiments, the adhesive can be applied in a continuous manner (e.g., along an entire length of a first of the plurality of layers 220, a second of the plurality of layers 220, or combinations thereof) or in a discontinuous manner (e.g., along less than an entire length of the first of the plurality of layers 220, the second of the plurality of layers 220, or combinations thereof). In some embodiments, the adhesive can be applied onsite of the building or offsite (e.g., during manufacturing or the like). In some embodiments, when applied onsite, the adhesive can be a tape or a liquid adhesive that is applied to the building structure or to the plurality of layers 220 before they are stacked.

In some embodiments, suitable fasteners include nails; screws; dowels; any combination thereof; or the like.

In some embodiments, thermal joining can include welding; fusing; tacking; or any combination thereof.

In some embodiments, ultrasonic joining can include welding; fusing; tacking; or any combination thereof.

In the illustrated embodiment, the building structure 218 includes three layers of the material 210. It is to be appreciated that this is an example and that fewer or additional layers of the material 210 can be included in the building structure 218. Furthermore, one or more additional materials (e.g., see FIG. 16 and its corresponding description below) can be included in the building structure 218.

In the illustrated embodiment, the building structure 218 includes rectangular shaped layers. It is to be appreciated that this is an example and that the material 210 can be manufactured to have a different geometry such that the building structure 218 has a different geometry.

In the illustrated embodiment, the building structure 218 includes layers of the material 210 stacked in alignment. It is to be appreciated that one or more of the layers can be stacked such that edges of the layers of the material 210 are not aligned.

In the illustrated embodiment, the building structure 218 includes a channel 222. The layers 220 of the material 210 can include an aperture therethrough. When stacked as in the illustrated embodiment, the apertures may be aligned, thereby forming the channel 222. In some embodiments, the channel 222 can receive piping or the like when the building structure is formed at the building site. This can, for example, simplify an effort to install plumbing, electrical, or heating, ventilation, air conditioning, and refrigeration (HVACR) features of the building structure. In some embodiments, the aperture in the material 210 can be formed at the time of manufacturing. In some embodiments, the aperture in the material can be cutout onsite when creating the building structure. In the illustrated embodiment, the channel 222 is formed vertically within the building structure 218. It is to be appreciated that the channel 222 can be oriented in different manners according to a building structure design. In the illustrated embodiment, a single channel is shown. It is to be appreciated that additional channels may be included to form a network of channels for the plumbing, electrical, HVACR, or any combination thereof. In the illustrated embodiment, the channel 222 is formed in the interior surface material 212. It is to be appreciated that the channel 222 can additionally, or alternatively, be disposed in the exterior surface material 214, according to some embodiments.

Figure 16:
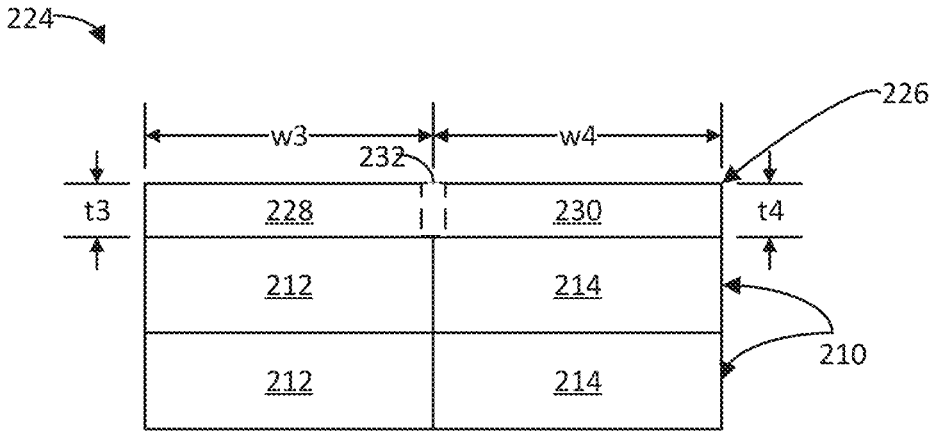
FIG. 16 illustrates a plurality of the first material of FIG. 14 in a stacked configuration with a plurality of a second material, according to some embodiments.

FIG. 16 illustrates a building structure 224 including the material 210 of FIG. 14 in a stacked configuration with a material 226, according to some embodiments. In some embodiments, the building structure 224 can be a wall of a building. In some embodiments, the building structure 224 can be a roof of a building.

The material 226 may be referred to as a composite material as the material 226 includes a first material, interior surface material 228, and a second material, exterior surface material 230. In some embodiments, the interior surface material 228 passes an environmental quality test. In some embodiments, the environmental quality test can include, but is not limited to, a test relating to the appearance of the interior surface material 212 (e.g., an L.A.B. color test or the like), a test relating to the ability of the interior surface material 212 to resist mold on surfaces thereof (e.g., ASTM D3273), any combination thereof, or the like. In some embodiments, the exterior surface material 230 passes one or more accelerated weathering tests simulating damage caused by outdoor weathering. In some embodiments, an accelerated weathering test includes, but is not limited to, ASTM G0155-05A, ASTM D6878-08, and any combination thereof.

In some embodiments, the material 226 can be a solid material. For example, the material 226 can be already cured or solidified. As such, unlike prior methods, the material 226 is not applied in a liquid form onsite and then cured. In some embodiments, the material 226 can be in a strip form. In some embodiments, the material 226 can be flexible such that it is rolled into a rolled form. In some embodiments, the material 226 may have a length at manufacturing that can be customized at a building site. For example, the material 226 can be manufactured to be 10 feet in length and trimmed down to, for example, 8 feet at a building site prior to installation.

In some embodiments, the interior surface material 228 can have a thickness t3 and a width w3. In some embodiments, the exterior surface material 230 can have a thickness t4 and a width w4. In some embodiments, the thickness t3 and the thickness t4 can be different. In some embodiments, the width w3 and the width w4 can be different. In some embodiments, the thickness t3, the thickness t4, or combinations thereof, can be from 0.001 inches to 6 inches. It is to be appreciated that these numbers are examples and that the thickness t3, the thickness t4, or combinations thereof can be thicker than 6 inches. The thickness t3, the thickness t4, or combinations thereof, may be selected based on a combination of the materials selected and the function of the material 226.

In some embodiments, the material 226 can have a different thickness than the material 210. In some embodiments, the material 226 can have a different width than the material 210.

In some embodiments, the interior surface material 228 can have a first length (into or out of the page) and the exterior surface material 230 can have a second length (into or out of the page). In some embodiments, the first length and the second length can be different.

In some embodiments, the interior surface material 228 can include plaster; gypsum board; wood; composites; fiber cement; polymers; metals; inorganics; or any combination thereof. In some embodiments, inorganics can include cement; mortar; or any combination thereof.

In some embodiments, the exterior surface material 230 can include wood; metal; laminates; organic materials; or any combination thereof.

In some embodiments, the wood can include lumber; particle board; plywood; glued laminates; cross-laminated timber; or any combination thereof.

In some embodiments, metal can include steel; iron-based (non-steel) metals; aluminum based metals; copper-based metals; nickel-based metals; other suitable metals; or any combination thereof. In some embodiments, steel can include stainless steel; surface treated steel; or any combination thereof. In some embodiments, surface treated steel can include galvanized steel; Galvalume® steel; other surface treated steels; or any combination thereof.

In some embodiments, laminates include any combination of polymers with metal; composites; inorganic materials; or any combination thereof. In some embodiments, laminates can be polymer based. In some embodiments, polymer based laminates include polymers laminated with wood; with metal; with other polymers; with synthetic composites; with inorganic materials; or any combination thereof. In some embodiments, inorganic materials include stone; cement; mortar; fiber cement; or any combination thereof.

In some embodiments, organic materials include polymers; plant-based resins; composites; or any combination thereof. In some embodiments, polymers include polyethylene; polypropylene; polycarbonate; epoxy; urethane; polyethylene terephthalate; polystyrene; asphaltic or bitumen based polymers; plastics; thermoplastics; thermosets; silicones; acrylates; silane-terminated polymers; other hybrid polymers; or any combination thereof. In some embodiments, urethanes include urethanes having renewable or natural polyol. In some embodiments, plant-based resins include urethane; tall oil pitch; or any combination thereof. In some embodiments, composites include renewable or natural fibers; renewable or natural particulates; particulates; or any combination thereof. In some embodiments, renewable or natural fibers include grass-based fibers; stalk-based fibers; seed or fruit fibers; leaf fibers; stem fibers; wood fibers; or any combination thereof. In some embodiments, particulates include wood dust; minerals; rice hull; stone; recycled particulates; glass; or any combination thereof.

In some embodiments, an intermediate material 232 may be disposed between the interior surface material 228 and the exterior surface material 230. In some embodiments, the intermediate materials include foam; honeycomb; truss or expanded structures; thermal insulation; air or moisture barriers; any combination thereof, or the like.

In the illustrated embodiment, the building structure 224 includes three layers of material (two layers of the material 210 and a layer of the material 226). It is to be appreciated that this is an example and that additional layers of the material 210 or the material 226, as well as additional materials could be included in the building structure 224.

In the illustrated embodiment, the building structure 224 includes rectangular shaped layers. It is to be appreciated that this is an example and that the material 210, the material 226, or any combination thereof, can be manufactured to have a different geometry such that the building structure 224 has a different geometry.

In the illustrated embodiment, the building structure 224 includes layers of the material 210 and the material 226 stacked in alignment. It is to be appreciated that one or more of the layers can be stacked such that edges of the layers of the material 210, edges of the material 226, or any combination thereof are not aligned.

Figure 17:
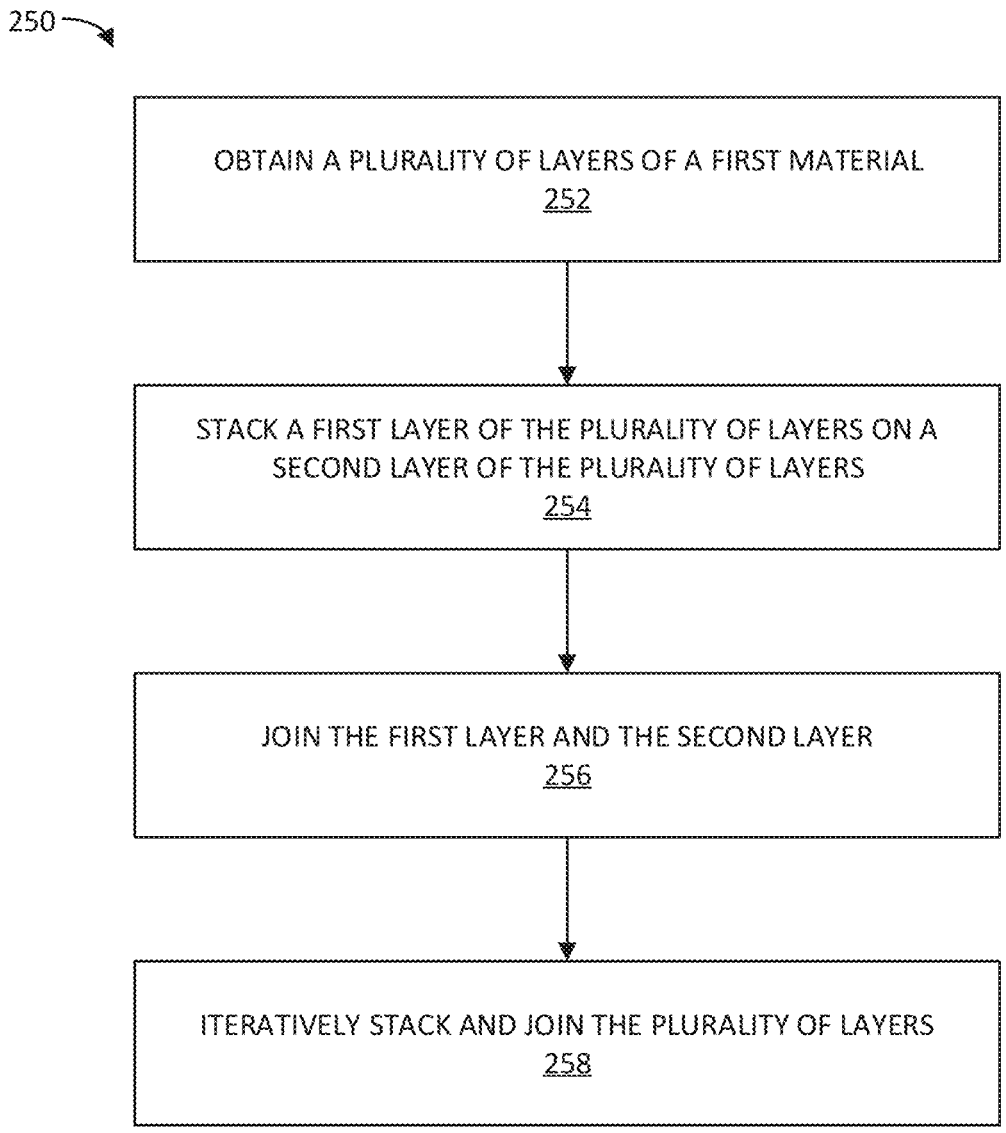
FIG. 17 illustrates a flowchart of a method, according to some embodiments.

FIG. 17 illustrates a flowchart of a method 250, according to some embodiments. The method 250 can generally be performed to create a building structure from the material 210 (FIG. 14), according to some embodiments.

In some embodiments, the method 250 includes obtaining a plurality of layers of a first material at block 252. In some embodiments, the first material is the material 210 (FIG. 14).

In some embodiments, the method 250 includes stacking a first layer of the plurality of layers of the first material on a second layer of the plurality of layers of the first material at block 254.

In some embodiments, the method 250 includes joining the first layer of the plurality of layers of the first material and the second layer of the plurality of layers of the first material at block 256. In some embodiments, the joining can include heating the plurality of layers; applying an adhesive to one or more of the plurality of layers; ultrasonically welding the plurality of layers; or any combination thereof.

In some embodiments, the method 250 includes iteratively stacking and joining the plurality of layers so as to form a building structure at block 258.

Figure 18:
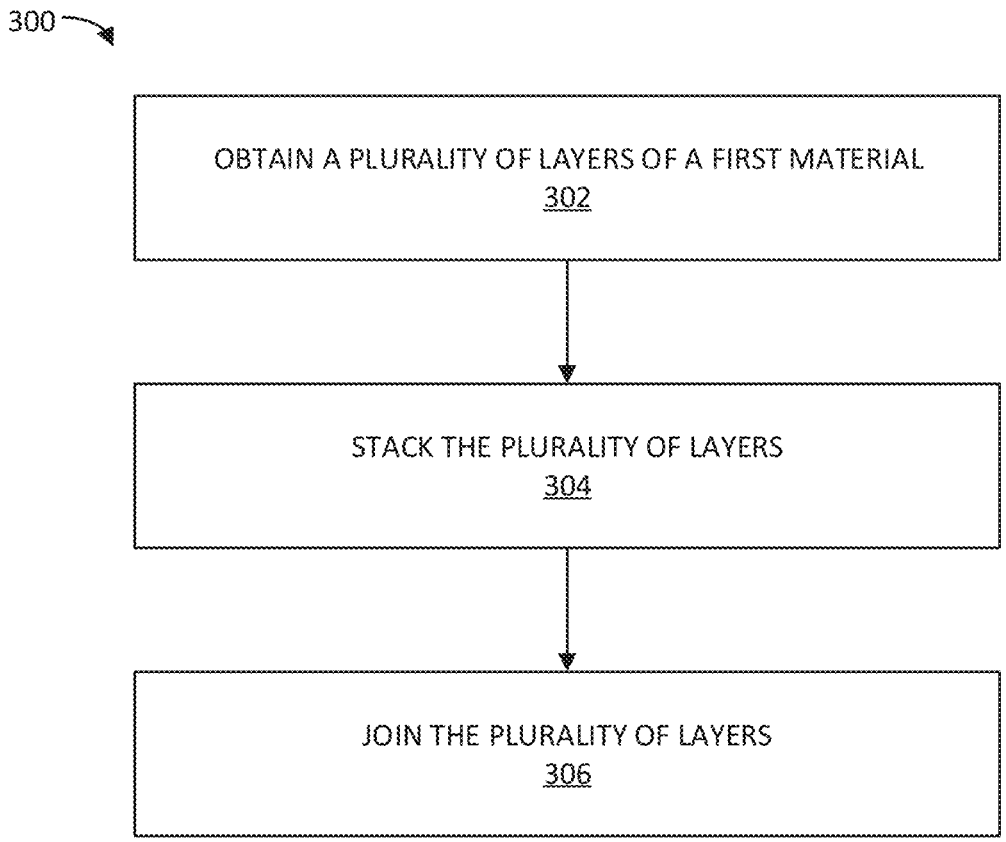
FIG. 18 illustrates a flowchart of a method, according to some embodiments.

FIG. 18 illustrates a flowchart of a method 300, according to some embodiments. The method 300 can generally be performed to create a building structure from the material 210 (FIG. 14), according to some embodiments.

In some embodiments, the method 300 includes obtaining a plurality of layers of a first material at block 302.

In some embodiments, the method 300 includes stacking the plurality of layers of the first material at block 304.

In some embodiments, the method 300 includes joining the plurality of layers of the first material so as to form a building structure at block 306. In some embodiments, the joining can include heating the plurality of layers; applying an adhesive to one or more of the plurality of layers; ultrasonically welding the plurality of layers; or any combination thereof.

The method 300 of FIG. 18 generally differs from the method 250 of FIG. 17 in how the joining of the plurality of layers is completed. In the method 250, each of the plurality of layers is joined before moving to stacking the next of the plurality of layers. Conversely, in the method 300, the plurality of layers is stacked before joining the stacked plurality of layers.

The terminology used herein is intended to describe embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

It is to be understood that changes may be made in detail, especially in matters of the construction materials employed and the shape, size, and arrangement of parts without departing from the scope of the present disclosure. This Specification and the embodiments described are examples, with the true scope and spirit of the disclosure being indicated by the claims that follow.

What is claimed is:

1. A kit, comprising:

a plurality of wall members, wherein the plurality of wall members includes at least a first wall member, a second wall member, a third wall member, a fourth wall member, and a fifth wall member, wherein each of the plurality of wall members includes:

an exterior surface material, wherein the exterior surface material is chosen from the group consisting of metal, wood, laminate, or organic material, wherein the exterior surface material, when tested by an accelerated weathering test simulating damage caused by outdoor weathering, passes the accelerated weathering test;

an interior surface material, wherein the interior surface material is chosen from the group consisting of plaster, gypsum board, stone composites, fiber cement, polymer materials, or inorganic materials, wherein the interior surface material, when tested by an environmental quality test, passes the environmental quality test;

wherein the exterior surface material is different than the interior surface material;

a protruding portion;

a channel between the exterior surface material and the interior surface material; and a removable release liner on the interior surface material, wherein the first wall member is configured to be stacked vertically above the second wall member, with the protruding portion of the first wall member inserted into the channel of the second wall member, between the exterior surface material and the interior surface material of the second wall member, thereby to form a portion of a wall of a structure, wherein each of the first wall member and the second wall member includes the exterior surface material and the interior surface material prior to stacking vertically to form the portion of the wall, wherein the third wall member is configured to be stacked vertically above the second wall member, thereby to form another portion of the wall, wherein the third wall member includes the exterior surface material and the interior surface material prior to stacking vertically to form the another portion of the wall;

a plurality of brackets, wherein the plurality of brackets comprises at least a first bracket and a second bracket, wherein the first bracket includes a first end that is configured to receive ends of the first wall member, the second wall member, and the third wall member, and a second end configured to receive an end of the fourth wall member, wherein the second bracket includes a third end that is configured to receive ends of the first wall member, the second wall member, and the third wall member, and a fourth end that is configured to receive an end of the fifth wall member; and a door.

2. The kit of claim 1, further comprising a window.

3. The kit of claim 1, further comprising a plurality of windows.

4. The kit of claim 1, wherein the plurality of wall members is joinable to form a roof.

5. The kit of claim 1, wherein the kit is configured to be installed on a concrete slab.

6. The kit of claim 1, wherein the second bracket is configured to maintain the first wall member and the fifth wall member substantially perpendicular to each other.

7. The kit of claim 1, wherein the plurality of wall members includes a wall member comprising a plurality of prewired electrical outlets.

8. The kit of claim 1, wherein the kit includes a plurality of second wall members having a smaller thickness than the plurality of wall members.

9. The kit of claim 1, wherein the kit is configured to be positioned on a truck prior to assembly of the plurality of wall members, the plurality of brackets, and the door, to form the structure.

10. A kit, comprising:

a plurality of wall bodies, wherein the plurality of wall bodies comprises at least a first wall body, wherein each of the plurality of wall bodies includes an exterior groove and an interior groove, a plurality of wall panels, wherein the plurality of wall panels comprises at least a first wall panel, a second wall panel, a third wall panel, and a fourth wall panel, wherein each of the first wall panel and the second wall panel includes an exterior surface material and an insulation material, wherein each of the first wall panel and the second wall panel is configured, when tested by an accelerated weathering test simulating damage caused by outdoor weathering, to pass the accelerated weathering test;

wherein the first wall panel and the second wall panel are configured to be inserted into the exterior groove of the first wall body, thereby at least partially covering a first surface of the first wall body, wherein the exterior surface material of the first wall panel overlaps the exterior surface material of the second wall panel, and the third wall panel and the fourth wall panel are configured to be inserted into the interior groove of the first wall body, thereby at least partially covering a second surface of the first wall body, thereby to form a wall, wherein surfaces of the first wall panel and the second wall panel are configured to form an exterior surface of the wall, and wherein surfaces of the third wall panel and the fourth wall panel are configured to form an interior surface of the wall;

a plurality of corner brackets, wherein the plurality of corner brackets is configured to join a first of the plurality of wall bodies and a second of the plurality of wall bodies;

a roof bracket, wherein the roof bracket is configured to form a roof peak; and a door.

11. The kit of claim 10, wherein the first wall body includes a release liner configured to protect the first wall body during shipment of the kit.

12. The kit of claim 10, wherein the plurality of wall bodies comprises at least a third wall body configured to form at least a portion of a roof.

13. The kit of claim 10, wherein the kit is configured to be installed on a concrete slab.

14. The kit of claim 10, wherein the kit includes a window.

15. The kit of claim 10, wherein the kit includes a plurality of windows.

16. The kit of claim 10, wherein the plurality of corner brackets is configured to maintain at least two wall bodies of the plurality of wall bodies perpendicular to each other.

17. The kit of claim 10, wherein the exterior surface material includes at least one of wood, metal, laminates, or organic materials.

18. The kit of claim 10, further comprising at least one of a plurality of roof supports; a subfloor; or a plurality of roof trusses.

* * * * *